US006718739B2

(12) United States Patent
Kohl et al.

(10) Patent No.: US 6,718,739 B2
(45) Date of Patent: Apr. 13, 2004

(54) TUBE PACK BAG MAKING

(75) Inventors: Garrett William Kohl, Allen, TX (US); Steven Kenneth Tucker, Hurst, TX (US); Anthony Robert Knoerzer, Allen, TX (US); Jay E. Gehring, Frisco, TX (US)

(73) Assignee: Frito-Lay North America, Inc., Plano, TX (US)

( * ) Notice: Subject to any disclaimer, the term of this patent is extended or adjusted under 35 U.S.C. 154(b) by 0 days.

(21) Appl. No.: 10/117,400

(22) Filed: Apr. 5, 2002

(65) Prior Publication Data

US 2002/0170273 A1 Nov. 21, 2002

(51) Int. Cl.[7] ..... B65B 9/20
(52) U.S. Cl. ..... 53/551; 53/552; 141/286
(58) Field of Search ..... 53/450, 451, 551, 53/552; 141/286

(56) References Cited

U.S. PATENT DOCUMENTS

| | | | | | |
|---|---|---|---|---|---|
| 2,872,762 | A | * | 2/1959 | Dreeben | 53/551 |
| 3,636,826 | A | * | 1/1972 | Bowen et al. | 53/551 |
| 4,424,837 | A | * | 1/1984 | Farrell | 141/286 |
| 4,608,810 | A | * | 9/1986 | Bordini | 53/551 |
| 4,637,426 | A | * | 1/1987 | Lyon | 141/286 |
| 4,827,697 | A | * | 5/1989 | Ross | 53/451 |
| 4,924,655 | A | | 5/1990 | Posey | |
| 4,925,438 | A | | 5/1990 | Wagner | |
| 5,030,190 | A | | 7/1991 | Woods et al. | |
| 5,247,970 | A | * | 9/1993 | Ryntveit et al. | 141/286 |
| 5,309,961 | A | | 5/1994 | Franke et al. | |
| 5,590,783 | A | | 1/1997 | Capy et al. | |
| 5,746,043 | A | * | 5/1998 | Terminella et al. | 53/451 |
| 5,822,958 | A | * | 10/1998 | Davis | 53/551 |
| 5,988,234 | A | * | 11/1999 | Wegman | 141/286 |
| 6,131,375 | A | | 10/2000 | Sperry | |
| 6,164,042 | A | | 12/2000 | Tobolka | |

FOREIGN PATENT DOCUMENTS

| | | |
|---|---|---|
| GB | Des. 2101909 | 5/2001 |
| WO | PCT/FR93/00303 | 10/1993 |

* cited by examiner

*Primary Examiner*—John Sipos
(74) *Attorney, Agent, or Firm*—Colin P. Cahoon; Carstens, Yee & Cahoon, LLP

(57) ABSTRACT

A method and device are disclosed for forming and filling tubes containing a product, with the filling process taking place from the longer side of the tube, rather than the shorter side. An elongated product delivery tube contains product diverters that evenly spread out the product, allowing a clean seal in less time. An optional vibrator helps the product to settle quickly. Throughput is increased over the prior art, as well as facilitating improvements in opening the tube and in marketing.

6 Claims, 3 Drawing Sheets

TUBE PACK BAG MAKING

BACKGROUND OF THE INVENTION

1. Technical Field

The present invention relates to packaging of a product on a vertical form, fill, and seal machine, and more particularly to forming, filling and sealing a short, wide bag with a product that has an irregular shape, or which does not naturally distribute itself well.

2. Description of Related Art

Form, Fill, and Seal

Vertical form, fill, and seal packaging machines are commonly used in the snack food industry for forming, filling, and sealing bags of chips and other like products. One such packaging machine is seen diagrammatically in FIG. 1. This drawing is simplified, and does not show the cabinet and support structures that typically surround such a machine, but it demonstrates the working of the machine well. Packaging film 110 is taken from a roll 112 of film and passed through tensioners 114 that keep it taut. The film then passes over a former 116, which directs the film as it forms a vertical tube around a product delivery cylinder 118. This product delivery cylinder 118 normally has either a round or a somewhat oval cross-section. As the tube is pulled downward by drive belts 120, the vertical tube of film is sealed along its length by a vertical sealer 122, forming a back seal 124. The machine then applies a pair of heat-sealing jaws 126 against the tube to form a transverse seal 128. This transverse seal 128 acts as the top seal on the bag 130 below the sealing jaws 126 and the bottom seal on the bag 132 being filled and formed above the jaws 126. After the transverse seal 128 has been formed, a cut is made across the sealed area to separate the finished bag 130 below the seal 128 from the partially completed bag 132 above the seal. The film tube is then pushed downward to draw out another package length. Before the sealing jaws form each transverse seal, the product to be packaged is dropped through the product delivery cylinder 118 and is held within the tube above the transverse seal 128.

The material that is fed into the form, fill, and seal machine is typically a packaging film, such as polypropylene, polyester, paper, polyolefin extrusions, adhesive laminates, and other such materials, or from layered combinations of the above. For many food products, where flavor retention is important, a metalized layer will form the innermost layer.

The form, fill, and seal machines are quite expensive, in the range of $250,000 each, but pay for themselves easily when compared to the cost of preformed bags and the machinery to fill them. However, in order to maximize the productivity of the form, fill, and seal machines, it is common for the product delivery tube 118 and former 116 to be made as a unit that is easily interchangeable in less than 15 minutes, so that different size packages can be made by the same machine. The length of the transverse seal can also be changed, by exchanging the sealing jaws, or in some cases, merely by exchanging the facing (the portion of the sealing jaws which actually makes contact with the packaging film). By changing these elements, as well as the width of film roll feeding into the machine and the programming of the machine, one form, fill, and seal machine can handle a number of different products in different size packages, limited primarily by the width of film the machine will handle, the maximum length of bag the machine is designed to handle, and the available former/delivery tube assemblies.

Tube Pack

With some products, it is desirable to package them in tubes, so that they are easily held in one hand. One familiar example is the tubes in which individual servings of ready-to-eat snacks such as peanuts are packaged, shown in FIG. 2. The tube 200 can provide a serving or more of the product, yet by opening on the shorter end, its shape makes it easy to pour out small amounts at a time. The tube 200 for peanuts or similar snacks is manufactured on a vertical form, fill, and seal machine: a narrow tube is formed around an equally narrow delivery tube and a back seal 210, seen in phantom, is formed. The lower transverse seal 212A is formed and the film is pulled. The tube is filled through the shorter end of the tube and the final transverse seal 212B is formed. As can be imagined, filling a long, narrow tube with a given product is a much slower process than filling a wide package with the same product. This is because the product will tend to be slowed by hitting the walls of the delivery tube, as well as by product forming a "bridge" across the tube, even if only for a moment. This bridging is worsened when the product is irregularly shaped, or has a tendency to stick together, or where one part of the product is wider that other parts, all of which are true of many snack foods. Additionally, when the opening through which the product is dropped is relatively small, as is the current case in tube packs, the effect is worsened.

Currently, when packaging products into long, narrow tubes, the number of packages produced is much smaller than using the same machine to package into wider bags. This means that more run time is necessary to package a given amount of product, or alternatively, that more packaging machines are necessary to do the job in the same amount of time.

It would be much faster to fill a tube from its longer side, such as a short film draw with a wide transverse seal, but this strategy has its own inherent problems. In this mode, product tends to pile up in the center of the package, leaving the ends unfilled, while the height of product in the center interferes with formation of the final horizontal seal. It is possible to allow additional space at the top of the package so that product does not interfere with forming the seal, but the package produced looks like it was under-filled, especially in comparison to similar products filled in the standard manner.

It would be desirable to find a method of producing tube packs that allows faster throughput, while still providing a well-filled package with a strong seal. Preferably one should be able to do this using the current form, fill, and seal machines, so that no large capital investments are necessary.

Another problem with existing tube packaging affects the consumer, rather than the manufacturer. When a consumer opens a tube package, it would generally be preferable to have the package tear smoothly and easily across the small end of the tube, as this creates an ideal small opening for controlling the rate of pouring of the snack foods. This has, however, been difficult to achieve.

In the current tube packages, the best method has been to provide a small cut 216 into the top transverse seal 212B. However, once the consumer tears through the seal, the tear is as likely, or more likely, to continue down the side of the tube as it is to neatly tear across the top of the tube.

Many packaging processes utilize oriented polymers. These are long-chain polymers that have been stretched and treated until the polymer has a specific alignment or orientation. When one or more layers of an oriented polymer are used in the thin films for snack packages, a cut or tear that runs parallel to the orientation will tend to tear in the direction of the orientation, although this will not be true of a cut that goes across the orientation of the polymers. Using an oriented polymer can thus help, in many applications, to achieve a cleaner tear. However, where a tear must start in one direction (downward across the top seal) and it is desirable to change the direction of the tear (to parallel to the seal), oriented polymers cannot help. Thus, it would also be desirable to have a better method of opening the tube.

SUMMARY OF THE INVENTION

In the present invention, tube packs are produced using a short pull length and a wide transverse seal, so that the product is delivered through the longer side of the tube. Rather than the traditional round or oval delivery tube, the innovative delivery tube has an almost rectangular shape, although the ends have a radius of curvature rather than a flat shape. Preferably, the delivery tube has one or more product diverters that cause the product to be spread evenly across the package. In some embodiments, an optional vibrator can be added to the former/delivery tube assembly, to help the product settle in the tube prior to sealing. Because the product is spread across the length of the package, the final seal can be formed without interference. Various embodiments of the invention will have one or more of the following advantages:

- throughput is increased, saving both time and money;
- effective seals are maintained;
- packages are comparably filled to older methods of packaging tubes;
- tube packs are produced on standard form, fill, and seal (FFS) machines, requiring only new former/delivery tube assemblies.
- allows for a larger face panel;
- allows better means of opening; and
- allows a compact multi-pack of product simply by altering the programming of the FFS machine.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

The invention will now be described with reference to FIGS. 3–6, which depict several exemplary embodiments.

Figure 3:
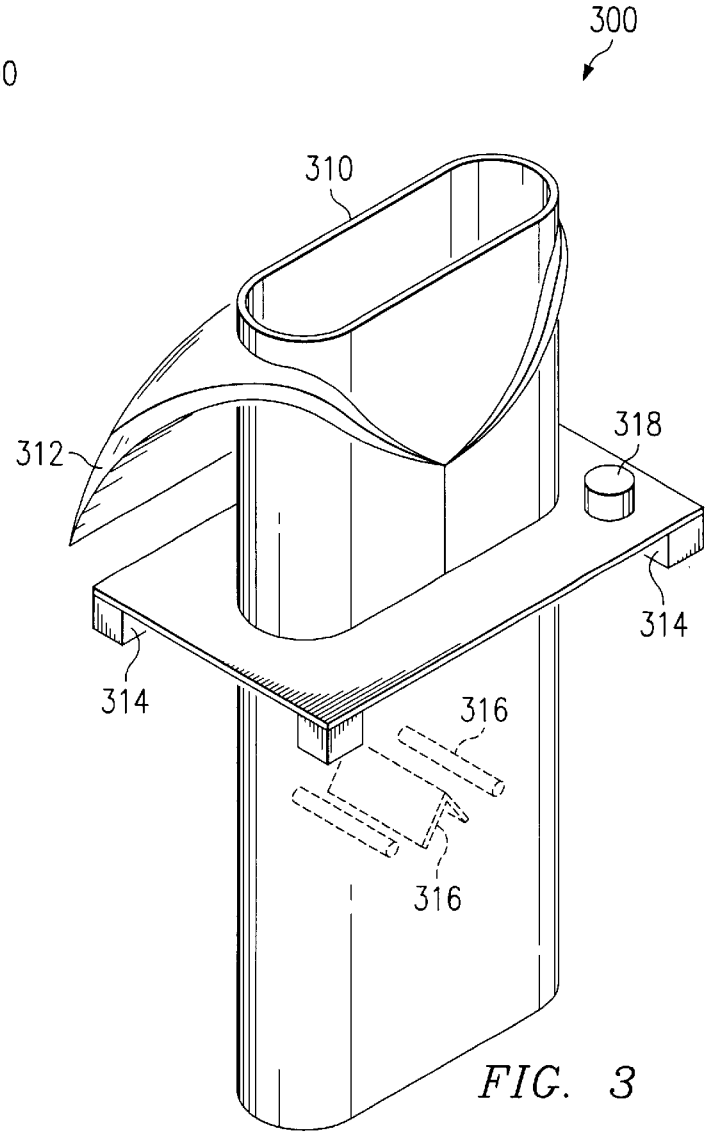
FIG. 3 is a perspective view of a former/delivery tube assembly according to an embodiment of the present invention.
Figure 4A:
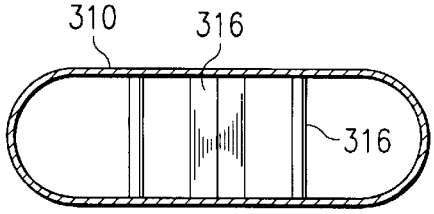
FIG. 4A is a cross-section of the former embodiment of FIG. 3.
Figure 4B:
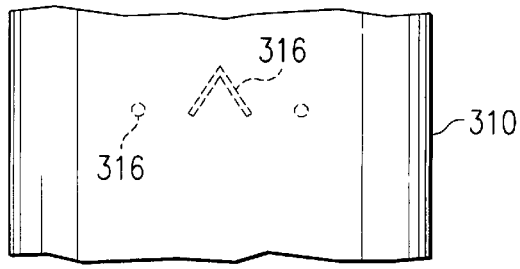
FIG. 4B is a side view of the delivery tube.

FIG. 3 shows an exemplary embodiment of a former/delivery tube assembly 300 used to package the horizontal tube packs, while FIGS. 4A and 4B show a cross-section and a side view of the delivery tube. The former 312 wraps around the delivery tube 310, ready to guide the packaging film into place. FIG. 4A shows a cross-section of the delivery tube, and is clearly not the traditional round or oval shape. Rather it is seen to have generally parallel front and back surfaces and rounded ends. This shape helps distribute the product, rather than causing the product to mound in one place, as it does with prior art shapes. Within the delivery tube, product diverters 316, shown in outline, are present to further spread the product out across the width of the tube. The exact size, shape, and placement of these product diverters 316 can vary from one embodiment to another, depending on the size of package and the particular product with which they will be used, but their function is to direct product to each side of the centerline, where they will more evenly disperse. Rubber mounts 314 help secure the assembly 300 in the form, fill, and seal machine and additionally providing some shock absorption. An optional vibrator 318 can be used to help the product settle quickly in the package. This vibrator can be timed so that it runs only when necessary to aid the product in settling in the package.

Figure 1:
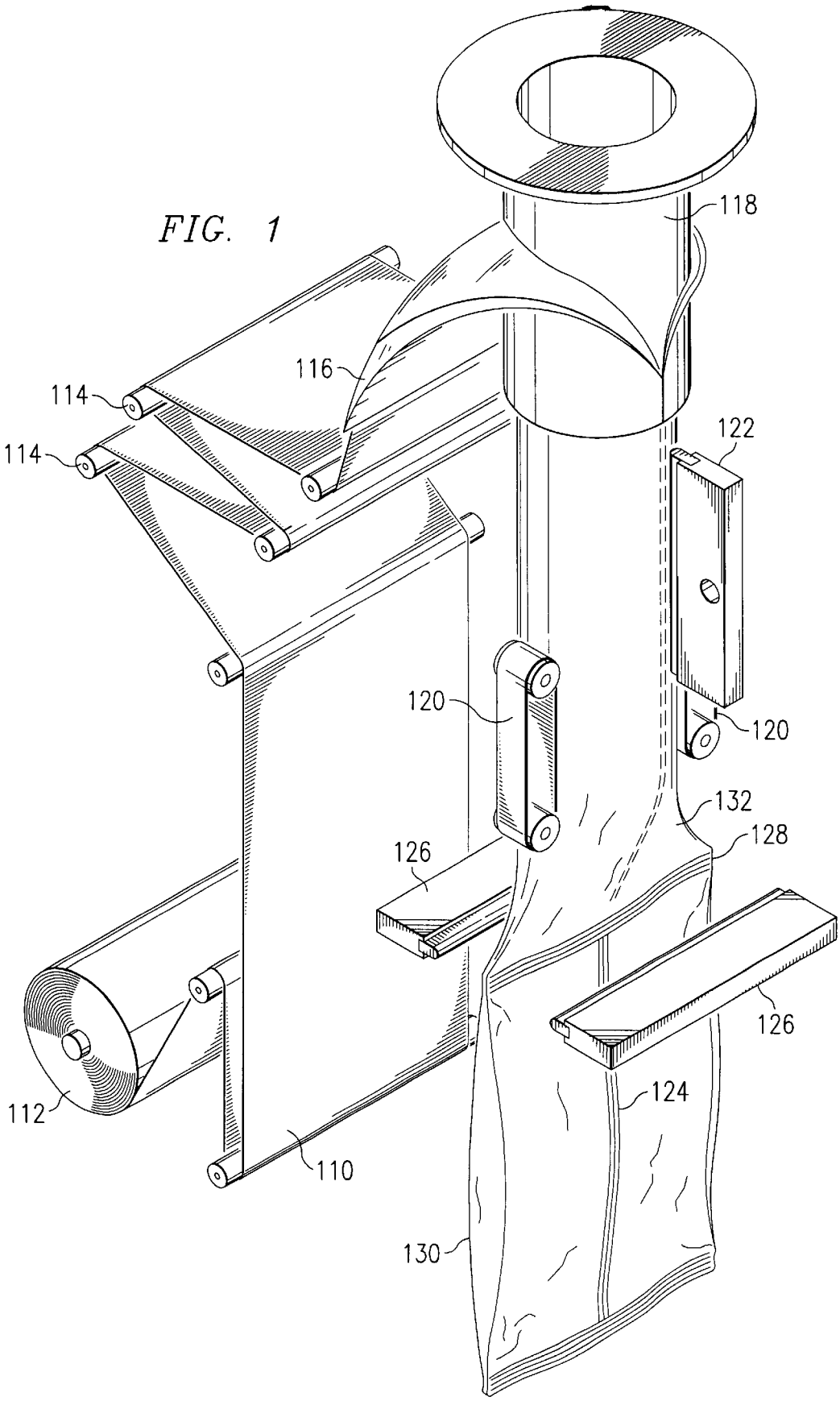
FIG. 1 is a perspective view of a prior art form, fill, and seal machine.
Figure 5:
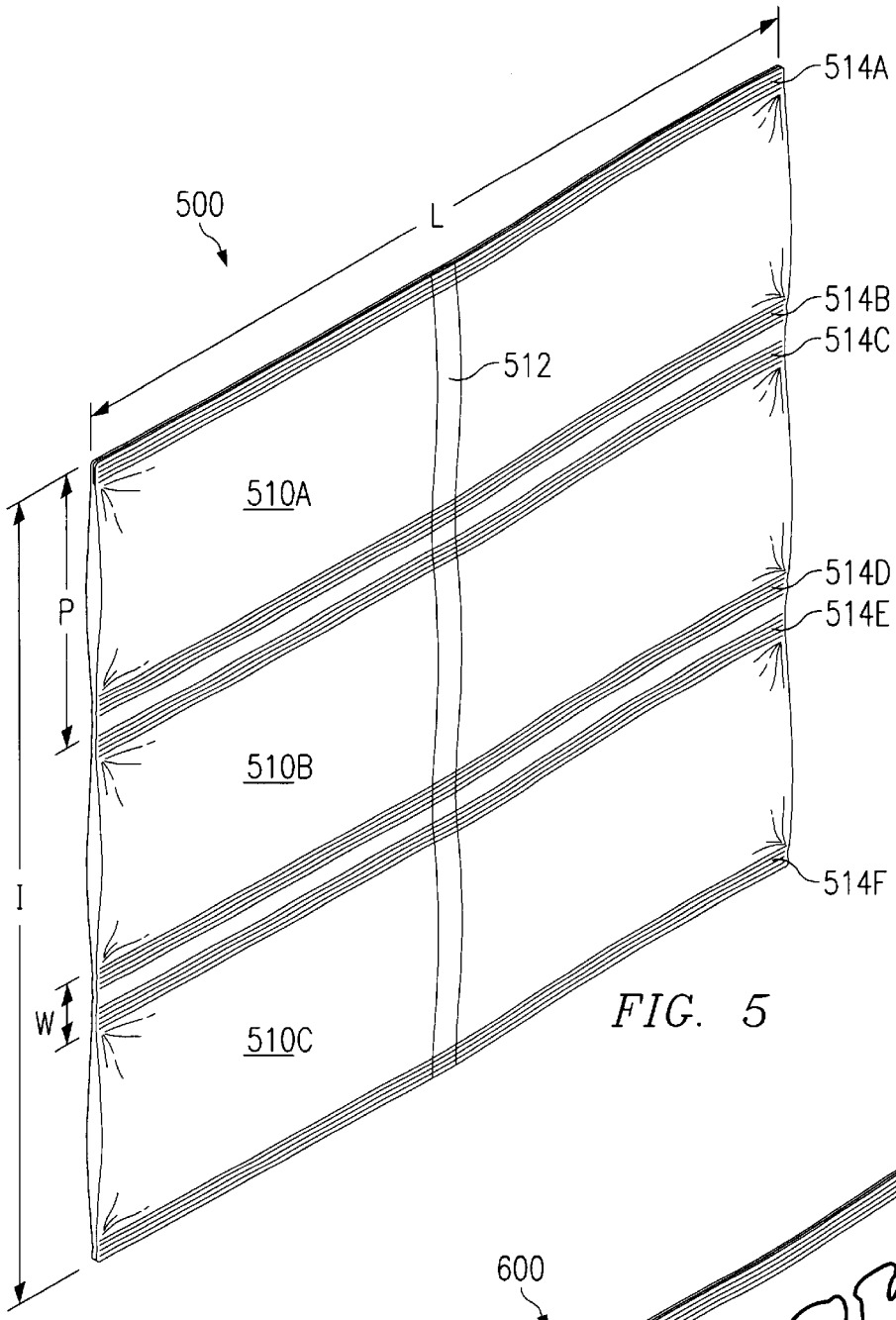
FIG. 5 is an exemplary embodiment of a multi-pack produced by using the former/delivery tube of FIG. 3.

Packaging a product using this former/delivery tube assembly will now be described with reference to prior art FIG. 1 and the former shown in FIG. 3, and to FIG. 5, which shows a three-pack 500 of tubes 510A, 510B, 510C as it comes off the form, fill, and seal machine. Packaging film is fed in over the former 312 so that it smoothly wraps around delivery tube 310. The ends of the packaging film are overlapped and a vertical back seal 512 is formed. This seal can be either a lap seal or a fin seal, as are well known in the industry. Sealing jaws 126 come together to form transverse seal 514F, as well as the unseen top transverse seal for the tube formed immediately before this multi-pack 500. After this seal was formed, the unseen prior multi-pack was separated from multi-pack 500 by a knife cut. The film is then advanced by one pull length P and product is fed into the delivery tube 310, where product diverters 316 cause the product to spread out. Optionally, vibrator 318 is run to help the product settle. Because the product is filled across the entire width of the delivery tube, the same amount of product can be dropped into the tube in a much shorter time than with the prior art. The packages are well filled, yet the sealing area remains clear even as the speed of packaging increases. Once the product is delivered, transverse seal 514D/E is formed, to complete tube 510C. Since this is to be a multi-pack, tube 510C is not separated from the tube following, although some means of aiding the consumer in separating the tubes 510B/C will be included in the design, such as perforations or scorings (not shown) between the adjacent transverse seals 514D/E.

The pull, fill, and seal process is repeated to form tube 510B, transverse seals 514B/C, tube 510A and transverse seal 514A, which is then separated from the transverse seal (not shown) of the multi-pack immediately following multi-pack 500. The distance between the cut below the bottom transverse seal 514F and the cut above the top transverse seal 514A is called an impression I. This is the length of film over which a single sequence of instructions are enacted. The current form, fill, and seal machines are limited to an impression length of 48 inches, so the maximum length of a multi-pack is 48 inches. The pull length P, which defines the vertical dimension of the package, can be any length $\leqq$48 inches, while the portion of the pull length that is usable for storage of the product is P-W, where W is the vertical dimension of the transverse seal. The longest side of the tube has a length of L, which is defined by the width of the packaging film (generally enough more than 2L to allow for the back seal) and the width of the sealing jaws 126.

In the exemplary embodiment of the invention that was first tested, the length L of the tube was 9½ inches, the pull length P was 4 inches, and the width W of the seal area was 1 inch.

This three-pack embodiment underscores the ease of making multi-packs using the new packaging innovations. When seals were made across the small end of the tube, it was only feasible to make multi-packs for small items; otherwise the packages quickly reached an unwieldy length. With the seals made along the longer side of the package, compact multi-packs are simple to produce by simply not cutting bags apart, although the bags preferably have some means of separation, such as the perforations mentioned.

Figure 2:
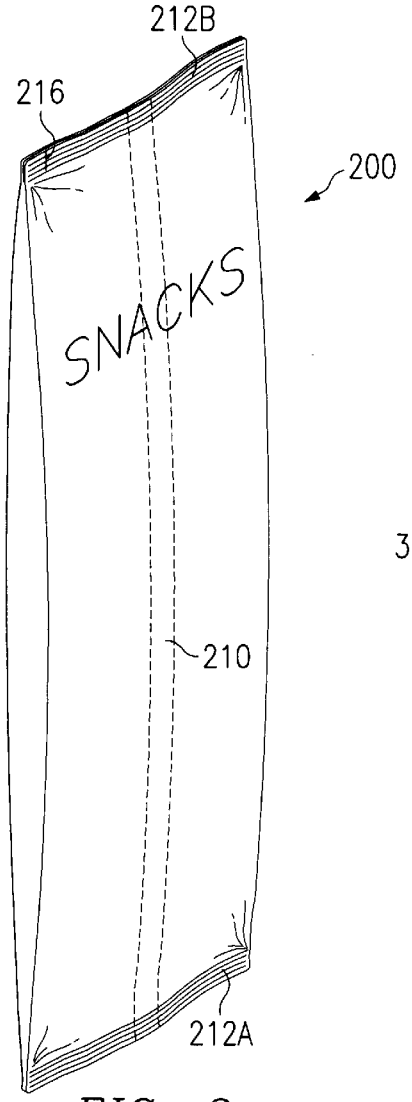
FIG. 2 (PRIOR ART)
FIG. 2 is a perspective view of a prior art tube pack.
Figure 6:
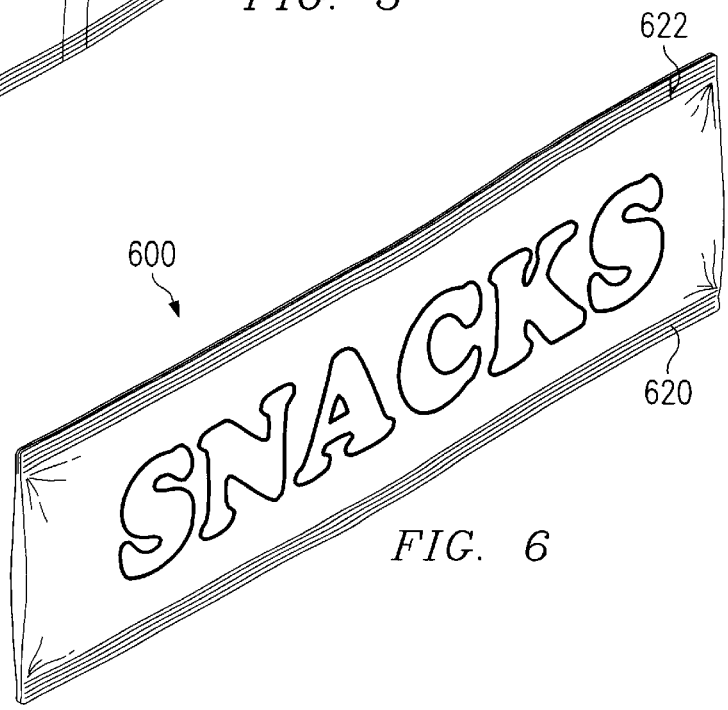
FIG. 6 shows a single bag produced by the innovative method.

FIG. 6 shows a single tube formed and filled by the innovative method. One marketing advantage is clear from this view as compared to prior art FIG. 2. The face of the package is wide, making it easier to utilize larger lettering and graphics in the package design. Another advantage is also shown, but is less obvious. Since the seals 620 are now on the longer sides of the packages, the cut 622 into the seal area, which helps the consumer tear the package open, can now be made in the direction of the desired opening, i.e., across the small end of the tube. By using one or more layers of oriented polymers, the tendency to continue the tear in the same direction is encouraged, unlike the prior art, where it was desirable to change the direction of the tear.

In one embodiment, the longer dimension of the tube is 2½ times as long as its shorter dimension, but is filled to at least 75% of its volume. In other embodiments, the tube can have an even greater disparity in dimension, such as a length more than 3 times as long and its width. In other embodiments, the tube can be filled to at least 80% of its volume.

From the disclosure above, it will be seen that this inventive method of packaging has many advantages over the existing method. The throughput of packaging is increased, yet effective seals are maintained and the packages are comparably filled to older methods of packaging tubes. No large capital investments are necessary, as standard form, fill, and seal machines are used, yet the new orientation allows for a larger face panel, allows features that encourage a neat opening of the tube, and allows a simply method of packaging a compact multi-pack of product.

While the invention has been particularly shown and described with reference to a preferred embodiment, it will be understood by those skilled in the art that various changes in form and detail may be made therein without departing from the spirit and scope of the invention.

What is claimed is:

1. A former/product delivery tube for a vertical form, fill, and seal machine, comprising:

a product delivery tube having first and second sides opposite each other, said first and second sides being substantially parallel, first and second rounded ends that join said first and second sides together, and product diverters attached to an inside surface of said product delivery tube;

a former, connected to said product delivery tube in such a manner that a packaging film can be routed over said former to be positioned around said product delivery tube;

wherein said former/product delivery tube is configured for removable attachment to a vertical form, fill, and seal machine configured to make and fill flexible packages.

2. The product delivery tube of claim 1, wherein said first and said second rounded ends are each semi-circular.

3. The product delivery tube of claim 1, further comprising a vibrator connected to said product delivery tube to vibrate product as it is dropped into a package.

4. A vertical form, fill, and seal machine, comprising:

a former, configured to receive a packaging film from a roll; a product delivery tube whose cross-section has first and second sides opposite each other, said first and second sides being substantially parallel; and first and second rounded ends that join said first and second sides together and product diverters attached to an inside surface of said product delivery tube, wherein said former is configured to guide the packaging film such that the packaging film is wrapped around said product delivery tube;

a first set of sealers, adjacent said product delivery tube, to seal the packaging film to itself such that the packaging film forms an elongated tube; and a second set of sealers, arranged below said product delivery tube to make a transverse seal across the elongated tube.

5. The vertical form, fill, and seal machine of claim 4, wherein said first and said second rounded ends are each semi-circular.

6. The improvement vertical form, fill, and seal machine of claim 4, further comprising a vibrator connected to said product delivery tube to vibrate product as it is dropped into a package.

* * * * *